US006446969B1

(12) United States Patent
Denoual

(10) Patent No.: US 6,446,969 B1
(45) Date of Patent: Sep. 10, 2002

(54) BOARD GAME APPARATUS

(76) Inventor: Thierry Denoual, Blue Orange Games Co., 415 Ash St., Mill Valley, CA (US) 94941

( * ) Notice: Subject to any disclaimer, the term of this patent is extended or adjusted under 35 U.S.C. 154(b) by 0 days.

(21) Appl. No.: 09/775,459

(22) Filed: Feb. 5, 2001

(51) Int. Cl.[7] ..... A63F 3/00
(52) U.S. Cl. ..... 273/261; 273/288; 273/291
(58) Field of Search ..... 273/242, 260, 273/256, 261, 262, 288, 291

(56) References Cited

U.S. PATENT DOCUMENTS

| | | | | |
|---|---|---|---|---|
| 2,585,268 | A | | 2/1952 | Olsen |
| 2,614,842 | A | | 10/1952 | Rice |
| 3,759,523 | A | * | 9/1973 | Randolph |
| 3,897,953 | A | | 8/1975 | Hoynanian |
| 3,947,037 | A | * | 3/1976 | Hasegawa |
| 4,052,069 | A | | 10/1977 | Sandhu |
| 4,805,915 | A | | 2/1989 | Lamle |
| D393,286 | S | | 4/1998 | Hasegawa |
| 5,791,650 | A | | 8/1998 | Pardee |

* cited by examiner

*Primary Examiner*—Benjamin H. Layno
*Assistant Examiner*—V K Mendiratta
(74) *Attorney, Agent, or Firm*—Douglas E. White

(57) ABSTRACT

A game board has a central playing field, called the territories, surrounded by a peripheral or perimeter playing field called the sacrifice zone. The board comprises 90 squares arranged in ten columns and nine rows. The squares form an ordered array of cells or positions for playing pieces, through which rectangular array vertical, horizontal and diagonal moves are possible. The thirty-four perimeter squares comprise a sacrifice zone that is one square wide, namely, the first and last columns and the top and bottom rows. The remaining fifty-six inner squares comprise the territories. Two sets of fourteen playing pieces of three types are assigned to the two players, each type of piece being allowed moves and captures according to individual rules. Special rules apply to pieces entering and occupying the sacrifice zone squares. Each piece is reversible—that is, one side of the piece bears on its top side indicia of the first player's set and on the obverse side indicia of the second player's set. Upon capture, an opponent's piece is physically reversed. The obverse side is turned up, which displays the primary indicia of the capturing player.

6 Claims, 8 Drawing Sheets

BOARD GAME APPARATUS

CROSS REFERENCE TO RELATED APPLICATIONS

Not Applicable

FEDERALLY SPONSORED RESEARCH OR DEVELOPMENT

Not applicable.

FIELD OF THE INVENTION

This invention relates to board games, more particularly, to a checkerboard style board game having reversible pieces and a peripheral "sacrifice" zone.

BACKGROUND OF THE INVENTION

Board games are old, many being derived from the familiar "checkerboard" arrangement of alternating light and dark squares within columns and rows. Many such games feature checker-like or chess-like moves involving side-to-side (hereinafter "vertical cal," having reference to the top and bottom of the drawing), forward and backward (hereinafter after "horizontal"), and diagonal moves, and variations thereof Such games often are directed rected toward the capture of a single piece out of the opponent's set.

Prior developments in this field may be generally illustrated by reference to the following information disclosure statement:

| Pat. No. | Patentee | Issue Date |
|---|---|---|
| 4,052,069 | S. Sandhu | Oct. 4, 1977 |
| Des. 393,286 | S. Hasegawa | Apr. 7, 1998 |
| 2,585,268 | P. Olsen | Feb. 12, 1952 |
| 3,897,953 | J. Hoynanian | Aug. 5, 1975 |
| 5,791,650 | S. Pardee | Aug. 11, 1998 |
| 2,614,842 | J. Rice | Oct. 21, 1952 |
| 3,759,523 | A. Randolph | Sep. 18, 1973 |
| 4,805,915 | S. Lamle | Feb. 21, 1989 |

U.S. Pat. No. 4,052,069 teaches a variation on chess where there is a capture row that holds pieces that can be released when a player's piece reaches the other side of the board.

U.S. Pat. Nos. D-393,286, U.S. Pat. Nos. 3,897,953 and 2,585,268 teach chess or chess-like boards 5 with extra or modified outside border squares.

U.S. Pat. No. 5,791,650 teaches a checkerboard type game with bi-colored pieces that switch sides upon capture and with specialized capture localities.

U.S. Pat. No. 2,614,842 teaches a checkerboard with a border zone into which a player can move (see column 3, lines 60–68).

The rest of the patents are representative of what was found in the art.

Some find play stifling when a player is confined to a set of pieces that is fixed in number and in type of piece—wherein one's count of pieces can only go down. Furthermore, the customary use of a checkerboard pattern is often felt to limit the possibility of play, particularly for pieces adjacent to the perimeter of the board.

SUMMARY OF THE INVENTION

In view of the disadvantages inherent in the known art, the general purpose of the present invention, which will be described subsequently in greater detail, is to teach a new and improved board game apparatus which has all of the important advantages of the prior art and few, if any, of the disadvantages to a player.

The novel game board of the present invention has a central playing field, called the territories, surrounded by a peripheral or perimeter playing field, called the sacrifice zone. The board comprises 90 "squares" arranged in ten columns and nine rows. The squares form an ordered array of cells or positions for playing pieces, through which rectangular array vertical, horizontal and diagonal moves are possible. The thirty-four perimeter squares comprise a sacrifice zone that is one square wide, namely, the first and last columns and the top and bottom rows. The remaining fifty-six inner squares comprise the territories. The squares of the territories field preferably are of a first set of alternating light and dark colors, with the sacrifice zone comprising squares of a second set of visually different alternating light and dark colors. However, other equivalent methods of distinguishing adjacent squares and of distinguishing the two fields may be selected. For example, distinctive cell indicia may be used at the cell locations instead of colored squares. Also, the playing cells may be formed into shapes other than squares that are functionally equivalent thereto.

Two sets of fourteen playing pieces of three types are assigned to the two players; each type of piece being allowed moves and captures according to individual rules. Special rules apply to pieces entering and occupying the sacrifice zone squares. The pieces bear markings, colors, shapes or like indicia which distinguish the three types. Each piece is reversible—that is, one side of the piece bears on its top (first or primary) face or side indicia of the first player's set and on the obverse (second or secondary) face or side indicia of the second player's set. Upon capture, an opponent's piece is physically reversed. The obverse verse side is turned up, which causes the display of the primary indicia of the capturing player, and the piece is returned to the square upon which it rested before being captured.

Features and Advantages

It is an object of the present invention to provide a new and improved board game apparatus that may be easily and efficiently manufactured and marketed.

A further object or feature of the present invention is a new and improved board game apparatus that is of a durable and reliable construction.

Still another object of the present invention is to provide a novel board game apparatus wherein an increased ease of setup and play is permitted relative to the art.

Another object or feature is a new and improved board game apparatus that is attractive in appearance and suitable for mass production.

Accordingly, a feature of this invention is a board game apparatus, including: a playing board; said playing board forming a territories playing field of fifty-six squares formed into a grid of rows and columns; said playing board forming a sacrifice zone playing field of thirty-four squares forming a perimeter that is one square wide that surrounds said territories playing field; a plurality of playing pieces divisible into a first and a second set of equal number; said first and second sets each comprising one emperor piece, six ambassador pieces, and seven governor pieces; said emperor pieces each having two emperor sides, one emperor side bearing distinguishing emperor's first-set indicia and the other emperor side bearing distinguishing emperor's second-set indicia; said ambassador pieces each having two ambassador sides, one ambassador side bearing distinguishing ambassador's first-set indicia and the other ambassador side bearing distinguishing ambassador's second-set indicia; and said governor pieces each having two governor sides, one governor side bearing distinguishing governor's first-set indicia and the other governor side bearing distinguishing governor's second-set indicia, wherein said playing pieces may be arranged into said first set having fourteen playing pieces and said second set having fourteen pieces by turning one of said emperor pieces emperor's first-set indicia side up and by turning the other one of said emperor pieces emperor's second-set indicia side up, by turning six of said ambassador pieces ambassador's first-set indicia side up and by turning the other six of said ambassador pieces ambassador's second-set indicia side up, and by turning seven of said governor pieces governor's first-set indicia side up and by turning the other seven of said governor pieces governor's second-set indicia side up.

A further feature is a game board wherein said territories playing field comprises squares of alternating first light and first dark colors, and said sacrifice zone playing field comprises squares of alternating second light and second dark colors.

A further feature is such an apparatus wherein said emperor's first-set indicia comprises a solid white circle inside a black ring that is inside a white ring and said emperior's second-set indicia comprises a solid black circle inside a white ring that is inside a black ring, said ambassador's first-set indicia comprises a solid black circle inside a white ring and said ambassador's second-set indicia comprises a solid white circle inside a black ring, and said governor's first-set indicia comprises a solid white circle and said governor's second-set indicia comprises a solid black circle.

Yet another feature is a game wherein said emperor pieces are larger than said ambassador pieces and said ambassador pieces are larger than said governor pieces.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty that characterize the invention are pointed out with particularity in the claims annexed to and forming part of this disclosure. The invention resides not in any one of these features taken alone, but rather in the particular combination of all of its structures for the functions specified.

There thus has been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trade-mark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "vertical," "horizontal," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWING

The invention will be better understood and objects other than those set forth above will become apparent when consideration is given to the following detailed description thereof. Such description makes reference to the annexed drawing wherein.

Figure 1A:
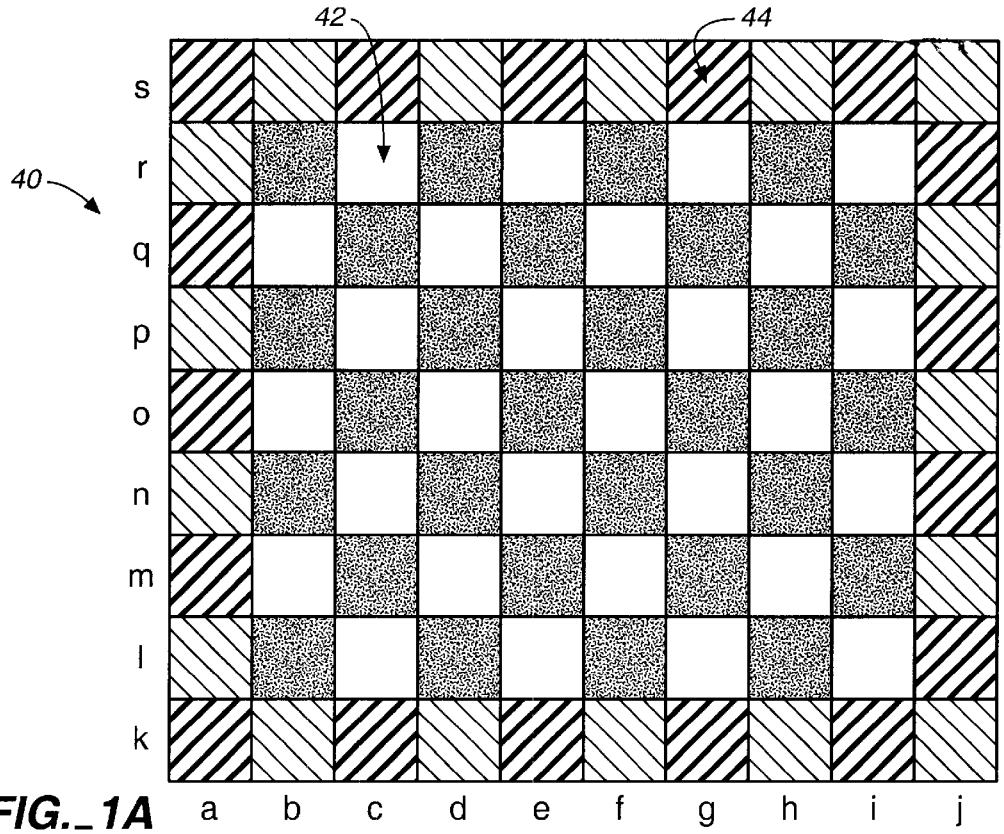
FIG. 1A is a plan view of the game board of the apparatus of FIG. 1.

DRAWING REFERENCE NUMERALS a–j columns
k–s rows
2 white set
4 black set
10 board game apparatus
12 emperor
12*w* emperor's white-set indicia
12*b* emperor's black-set indicia
14 emperor's white-set side
16 emperor's black-set side
22 ambassador
22*w* ambassador's white-set indicia
22*b* ambassador's black-set indicia
24 ambassador's white-set side
26 ambassador's black-set side
32 governor
32*w* governor's white-set indicia
32*b* governor's black-set indicia
34 governor's white-set side
36 governor's black-set side
40 board
42 territories field
44 sacrifice zone

DETAILED DESCRIPTION OF THE INVENTION

Figure 1:
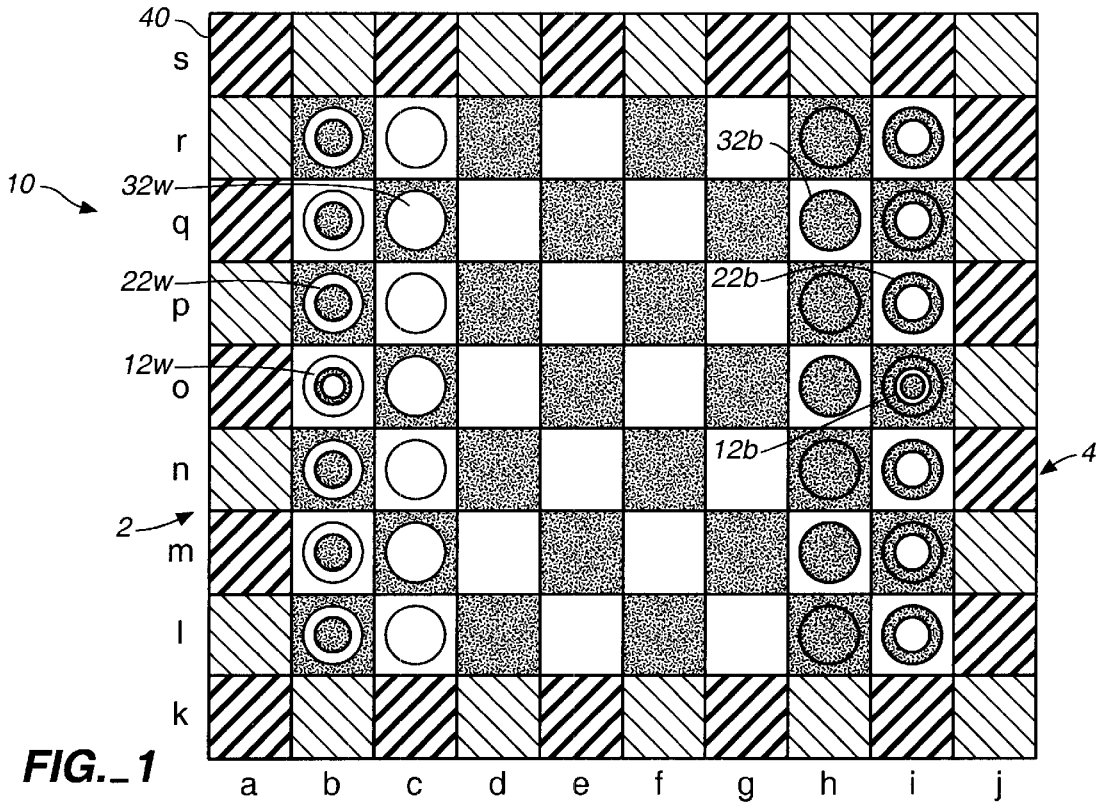
FIG. 1 is a plan view of a preferred board game apparatus of this invention.

Referring to FIG. 1, there is illustrated therein a new and improved board game apparatus 10 of this invention. The board game apparatus 10 generally comprises a board 40 and two sets of playing pieces having fourteen pieces per set. In FIG. 1, the fourteen pieces of the first (hereinafter "white") player's set 2 of playing pieces are placed in their starting positions on the left of the board 40 and the fourteen pieces of the second (hereinafter "black") player's set 4 of playing pieces are placed on their starting positions on the right of the board. The use of the words black and white is a historical convention employed only for the purpose of convenience and is not limited to any particular shade of color. Indeed, the pieces could be of a single color and identified by other indicia. For example, the "black" side could be of one shape and the "white" side another. The pieces are all reversible—one player has to position his or her pieces so that the light sides are on top; the other player uses the dark sides.

FIG. 1A illustrates a preferred arrangement of the ninety squares of the board 40, namely, they form ten columns a–j and nine rows k–s. The position of an individual square (or of a piece on said square) may be identified through a Cartesian coordinate system (x,y) wherein the lower horizontal edge of the board 40 comprises the x-axis and the left vertical edge thereof comprises the y-axis. Accordingly, the square at the lower left corner of the board will be referred to as (a,k), the upper right square as (j,s), and so on.

The playing field known as the territories 42 comprises the innermost fifty-six squares bounded by squares (b,l), (b,r), (i,r) and (i,l)—in other words, the cell range (b–i,l–r). The peripheral playing field known as the sacrifice zone 44 comprises the outermost thirty-four squares starting at square (a,k) and running clockwise around the board 40 to square (b,k). Both fields preferably comprise squares of alternating light and dark solid colors, with the sacrifice zone 44 preferably being comprised of squares of a second set of alternating light and dark solid colors that are visibly different from the alternating colors of the territories 42. This effect is shown schematically in the black and white drawing through the use of hatching in the sacrifice zone to represent the second set of light and dark colors. If desired, the board could be printed all in one color (or in two colors—one per field) and the cells or squares delineated by special markings.

The board 40 is designed so that each player will have in front of himself or herself two corners of the same color. If preferred, the lighter colored corner squares may be in front of the player with the lighter colored pieces—the opposite choice being shown in the drawing. For each player, the first column of squares in the territories field 42 is called the back line and the second one is called the front line. The white set 2 back line is the range of squares (b,l–r) and its front line is the range (c,l–r). The black set 4 back line is the range of squares (i,l–r) and its front line is the range (h,l–r).

Each player gets one emperor 12, six ambassadors 22 and seven governors 32. On each black line, pieces are placed in the following vertical order: three ambassadors 22, one emperor 12 and three ambassadors 22. On each front line are placed the seven governors 32.

Figure 2:
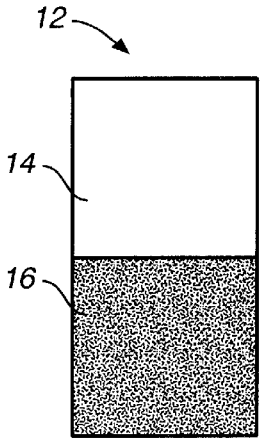
FIG. 2. is a frontal elevation of an emperor piece of the apparatus of FIG. 1.
Figure 2A:
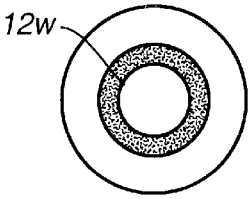
FIG. 2A is a plan view of the piece of FIG. 2.
Figure 2B:
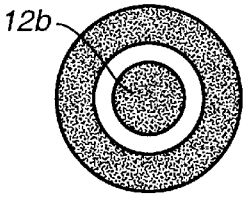
FIG. 2B is a bottom view of the piece of FIG. 2.

FIGS. 2, 2A and 2B illustrate the emperor 12 piece, of which there are only two—one in the white set 2 and one in the black set 4. FIG. 2 shows an emperor 12 in the white-set orientation, namely, with the emperor's white-set side 14 comprising the primary or visible up side. In the drawing, the emperor piece is shown with the emperor's black set-side 16 in the obverse or down position. The emperor's white-set side 14 bears or is formed into emperor's white-set indicia 12*w*. The emperor's black-set side 16 bears or is formed into emperor's black-set indicia 12*b*, which indicia preferably is a mirror image of the emperor's white-set indicia 12*w*, but which also could be an entirely different type of marking shape, color or the like. Preferably, the emperor's white-set indicia comprises a solid white circle inside a black ring that is inside a white ring and the emperor's black-set indicia comprises a solid black circle inside a white ring that is inside a black ring.

Figure 3:
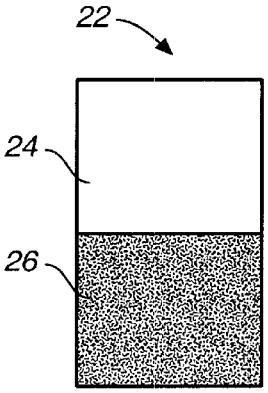
FIG. 3 is a frontal elevation of an ambassador piece of the apparatus of FIG. 1.
Figure 3A:
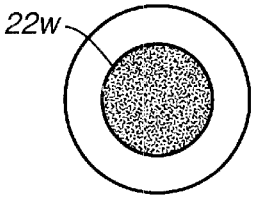
FIG. 3A is a plan view of the piece of FIG. 3.
Figure 3B:
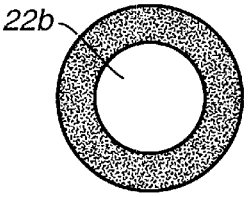
FIG. 3B is a bottom view of the piece of FIG. 3.

FIGS. 3, 3A and 3B illustrate the ambassador 22 piece, of which there are a total of twelve—six in the white set 2 and six in the black set 4. FIG. 3 shows an ambassador 22 in the white-set orientation, namely, with the ambassador's white-set side 24 comprising the primary, or visible, up side. The ambassador is shown with the ambassador's black-set side 26 in the obverse or down position. The ambassador's white-set side 24 has ambassador's white-set indicia 22*w*. The ambassador's black-set side 26 has ambassador's black-set indicia 22*b*, which indicia preferably is a mirror image of its ambassador's white-set indicia 22*w*. Preferably, the ambassador's white-set indicia comprises a solid black circle inside a white ring and the ambassador's black-set indicia comprises a solid white circle inside a black ring.

Figure 4:
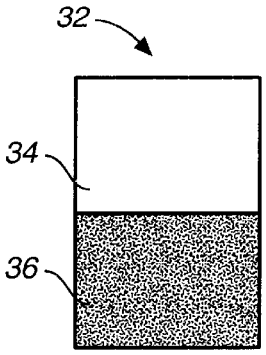
FIG. 4 is a frontal elevation of a governor piece of the apparatus of FIG. 1.
Figure 4A:
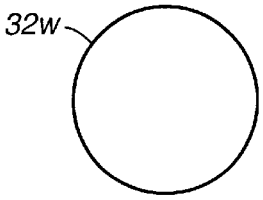
FIG. 4A is a plan view of the piece of FIG. 4.
Figure 4B:
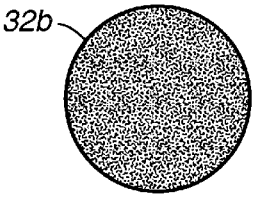
FIG. 4B is a bottom view of the piece of FIG. 4.

FIGS. 4, 4A and 4B illustrate the governor 32 piece, of which there are a total of fourteen—seven in the white set 2 and seven in the black set 4. FIG. 4 shows a governor 32 in the white-set orientation, namely, with the governor's white-set side 34 comprising the primary side. The governor is shown with the governor's black-set side 36 in the obverse position. The governor's white-set side 34 has ambassador's governor's white-set indicia 32*w*. The governor's black-set side 36 has governor's black-set indicia 32*b*, which indicia preferably is a mirror image of its white-set indicia. Preferably, the governor's white-set indicia comprises a solid white circle and the governor's black-set indicia comprises a solid black circle.

Accordingly, each set 2, 4 of fourteen pieces per set comprises one emperor, six ambassadors and seven governors. Note that in FIGS. 2, 3 and 4 the emperors 12 are taller than the ambassadors 22, which, in turn, are taller than the governors 32. The diameters of the pieces could show a similar progression of size. Accordingly, the pieces can be differentiated by size and/or by indicia. The pieces illustrated are differentiated by both. The names of the pieces can be different, but the three categories will always be distinguishable.

Figure 5:
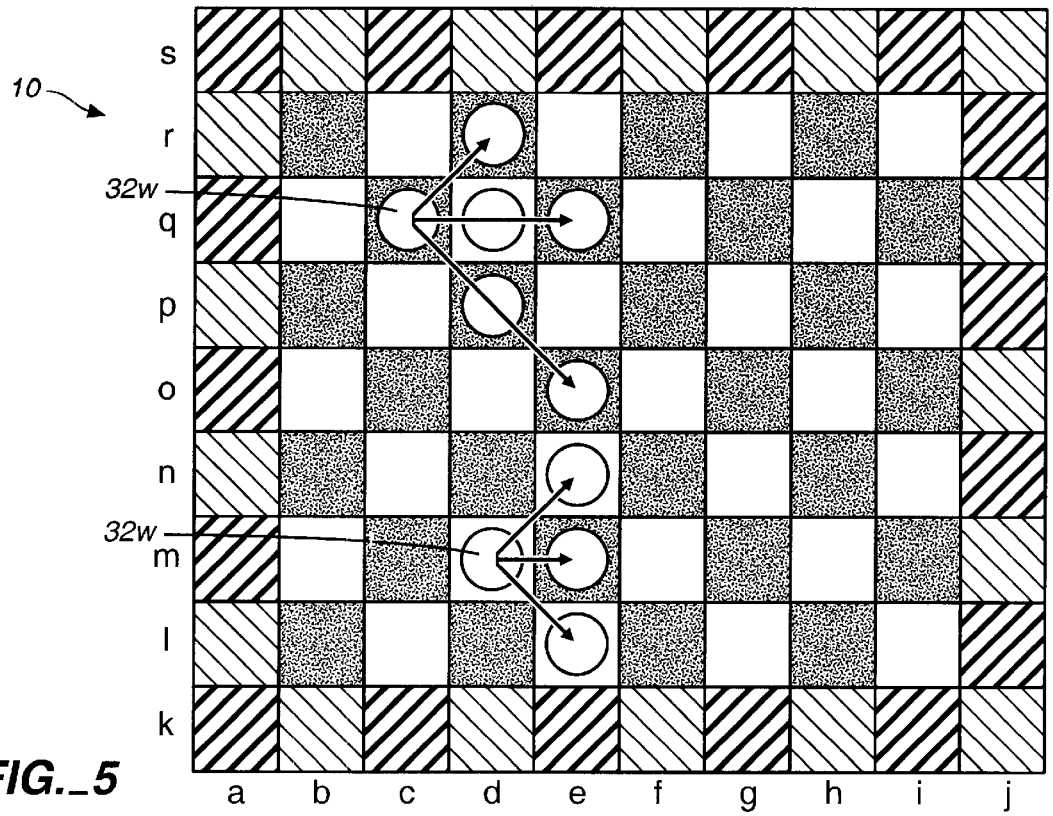
FIG. 5 is a plan view of the apparatus of FIG. 1, illustrating examples of the non-capture moves of the governor piece of FIG. 4.

FIG. 5 schematically illustrates the permissible range of non-capture moves for the governors 32. Governors can only move forward (either diagonally or horizontally straight) one square at a time. They may not move vertically (up and down in the drawing) and they may not go backward, i.e. not back (horizontally or diagonally) toward their respective starting positions. On the first move only, a governor may choose to move two squares instead of one. By convention, the set bearing the lighter color (white set 2) always makes the first move of the game. Thereafter, players make moves alternately.

In FIG. 5, only two of the white set 2 governor 32 pieces (displaying governor's nor's white-set indicia 32*w*) are actually on the board 40, namely, at squares (c,q) and (d,m). The remaining "pieces" are phantom images showing locations where the governors may move next (indicated by arrows). In other words, the piece displaying governor's white-set indicia 32*w* at (c,q) may move to squares (d,p), (d,q), (d,r), (e,o) or (e,q), assuming that is the first move of said piece. The white set 2 governor 32 at (d,m) must be in at least its second move. Accordingly, it may make non-capturing moves only to squares (e,l), (e,m), or (e,n). Pieces may not enter the sacrifice zone on non-capture moves.

Pieces capture by jumping over an opponent piece. All pieces capture in the same direction as they move, with one exception being that governors 32 cannot capture by moving straight forward (horizontally in the drawing). The square immediately following the targeted piece in the line of attack must be empty to allow capture (i.e. there must be a square just beyond the captured piece within which the capturing piece may land).

Figure 6:
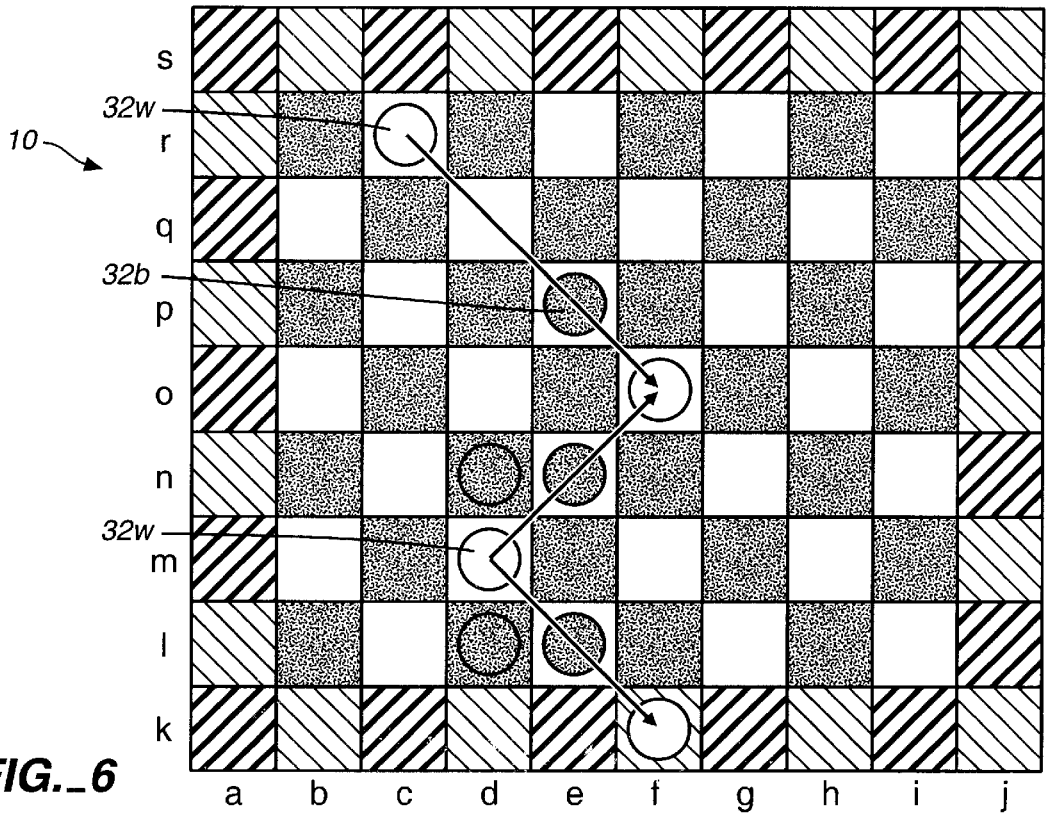
FIG. 6 is a plan view of the apparatus of FIG. 1, illustrating examples of the capture moves of the governor piece of FIG. 4.

FIG. 6 schematically illustrates the permissible range of capture moves for the governors 32. The piece showing governor's white-set indicia 32*w* at (c,r) may capture the black set 4 piece at (e,p) by moving diagonally and jumping it, landing at the open square at (fo). The piece showing governor's white-set indicia 32*w* at (d,m) may capture the black set 4 piece at (e,n) by moving diagonally and jumping it, landing at the open square at (f,o). Finally, the piece at (d,m) may capture the black set 4 piece in the territories 42 at (e,l) by moving diagonally and jumping it, landing at the open square at (f,k) in the sacrifice zone 44.

This last move illustrates the use of the sacrifice zone 44, namely, to end a capture move. When a piece enters the sacrifice zone 44, it stays there until a governor 32 of the same set reaches the opponent's back line. It is only at that time that a player can choose to put a sacrificed piece back into play. The sacrificed piece must reenter the game from its square in the sacrifice zone 44 using legal moves for its type, and the governor 32 that made it to the opponent's back line must take the place of the previously sacrificed piece in the sacrifice zone 44. Reaching the opponent's back line, exchanging the pieces, and moving the sacrificed piece out of the sacrifice zone 44 into the territories field 42 are all part of the same single move. A piece moving out of the sacrifice zone 44 can capture by using its legal moves. If there is no piece in the sacrifice zone 44 or if pieces cannot leave by using legal moves, the exchange cannot be done. A piece cannot move into the sacrifice zone except after jumping a piece to capture it—non-capture moves cannot end in the sacrifice zone.

When a piece is captured, it is physically reversed by the capturing player by turning the piece's obverse side up so that the obverse becomes the primary side. This causes the opposite (capturing player's) indicia to be displayed, thereby switching from the opponent player's set to the capturing player's. The piece then is returned to the square upon which it rested prior to capture. When a piece is captured, it cannot be recaptured during the next move, to avoid a deadlock by repetition of identical moves.

Figure 7:
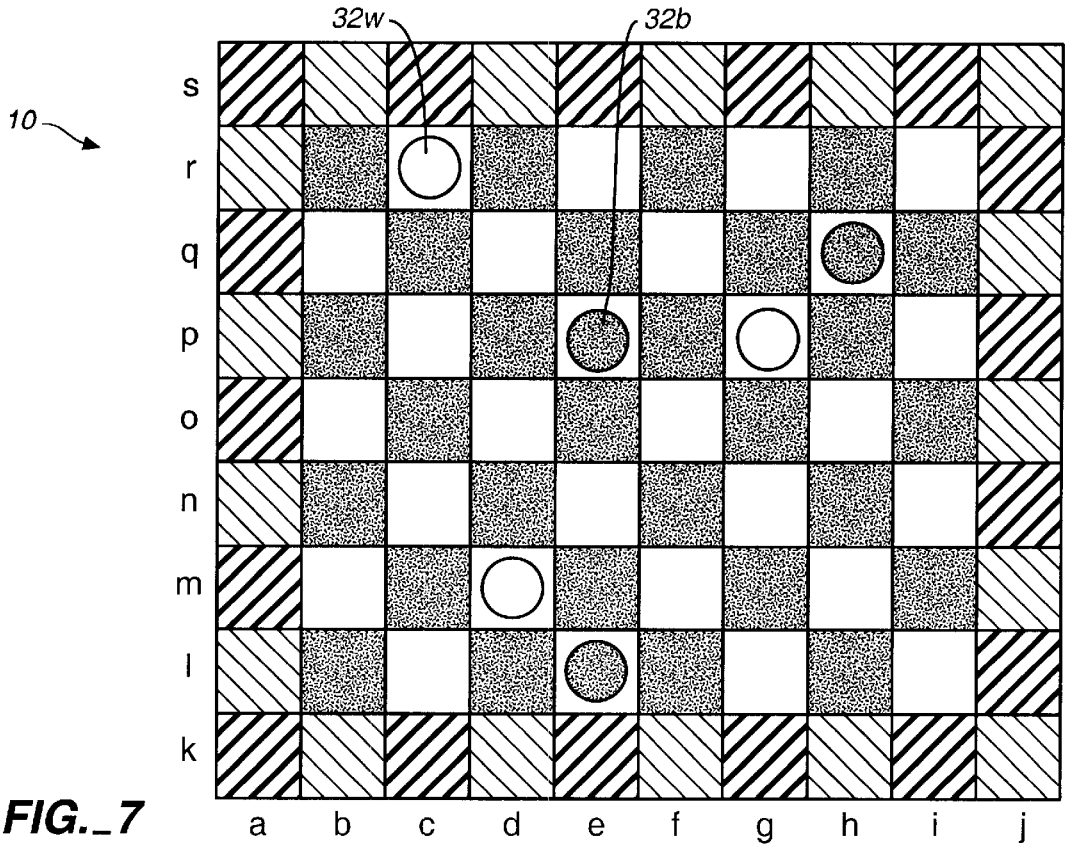
FIG. 7 is a plan view of the apparatus of FIG. 1, illustrating representative positions prior to capture moves of the governor piece of FIG. 4.
Figure 8:
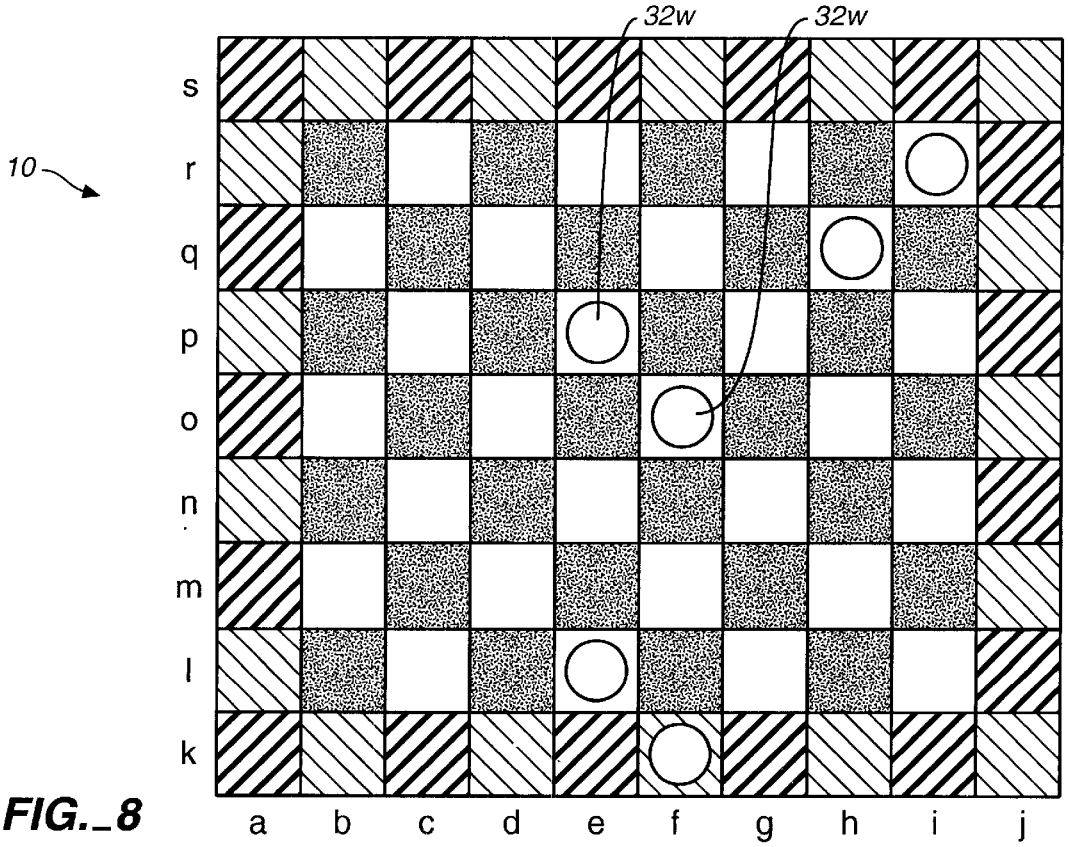
FIG. 8 is a plan view of the apparatus of FIG. 1, illustrating representative positions after capture moves of the governor piece of FIG. 4.

FIGS. 7 and 8 further illustrate the capture moves of the governors 32. In FIG. 7, a piece displaying governor's white-set indicia 32*w*, namely, a piece of the first player's white set 2, on square (c,r) is facing along its allowed-move direction (diagonal) a piece bearing governor's black-set indicia 32*b* of the second player's black set 4 on (e,p). A governor may move two spaces forward diagonally or horizontally on its first move, if no capture is involved. But with a capture (which can only be done diagonally), the effective total is three, as will be seen below. Also in FIG. 7, a white governor on (g,p) is facing a black piece (a black governor is shown there, but it could be any black piece) on (h,q). Finally, a white governor is on (d,m), facing a black piece on (e,l). Since the latter white piece may move and capture diagonally, and an empty space is available in the sacrifice zone 44, the white governor 32 on (d,m) may capture the black piece on (e,l) by moving into the sacrifice zone 44. FIG. 8 shows the resulting positions of the three white governors of FIG. 7 after having made their available capture moves. Note that the three black pieces have not been removed from the board 40 as a result of the capture. Rather, all three captured pieces remain in their places, but have had their transfer to the white set 2 signified by being turned over to display the white set indicia that was on their obverse sides. For example, the black piece on (e,p) that displayed governor's black-set indicia 32*b* in FIG. 7, displays in FIG. 8 governor's white-set indicia 32*w*. Note that the white governor 32 that was on (d,m) in FIG. 7, is on (f,k) in the sacrifice zone 44 in FIG. 8 after its capture move. As noted above, it cannot not be moved from square (f,k) in the sacrifice zone 44 until another white governor reaches the black player's vertical back line, namely squares (i,l–r).

Figure 9:
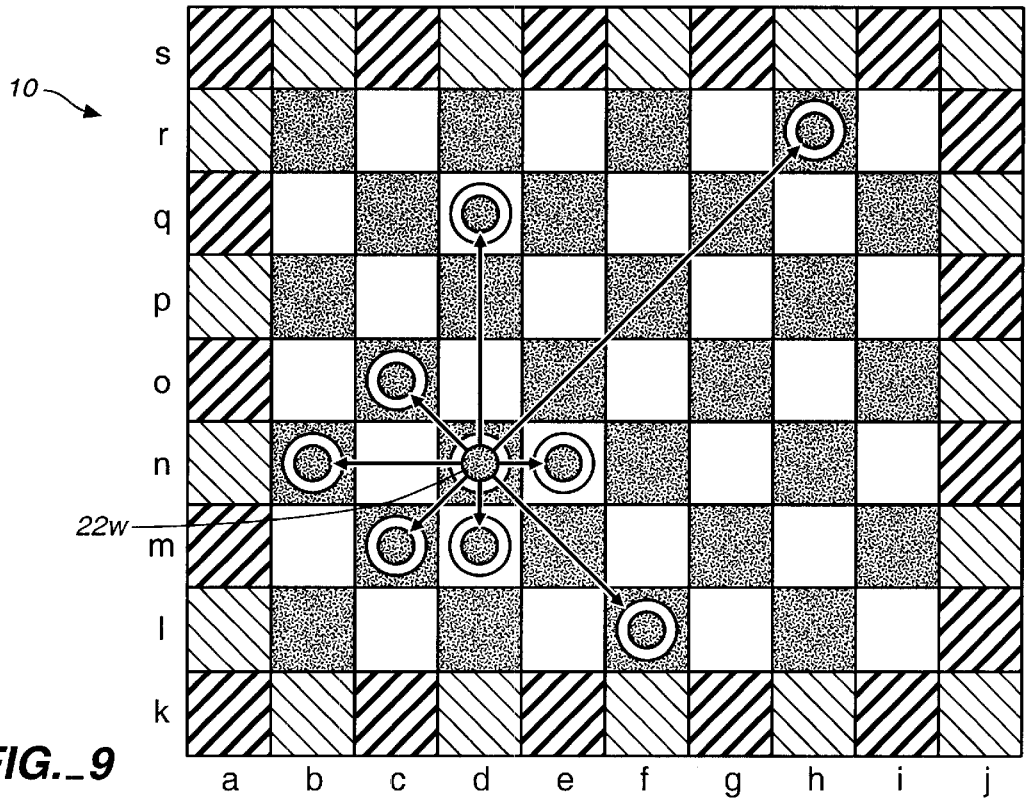
FIG. 9 is a plan view of the apparatus of FIG. 1, illustrating examples of the non-capture moves of the ambassador piece of FIG. 3.

FIG. 9 schematically illustrates the permissible range of non-capture moves for the ambassadors 22. Ambassadors can move in any direction along a horizontal, vertical or diagonal straight line of adjacent squares, and any distance—forward or backward—as long as no obstructing pieces intervene.

In FIG. 9, only one white set 2 ambassador 22 piece (displaying ambassador's white-set indicia 22*w*) is actually on the board 40, namely, at square (d,n). The remaining "pieces" are phantom images showing sample locations where that ambassador next may move (indicated by arrows). In other words, in FIG. 9 the piece displaying governor's white-set indicia 32*w* at (d,n) may move to any square along the vertical column (d,l–r), to any square along the horizontal row (b–i,n), to any square along the diagonal from (b,p) to (f,l), and to any square along the diagonal from (b,l) to (h,r). Of course, in practice, there likely would be intervening pieces of both sets blocking many of these possible ambassador moves.

Figure 10:
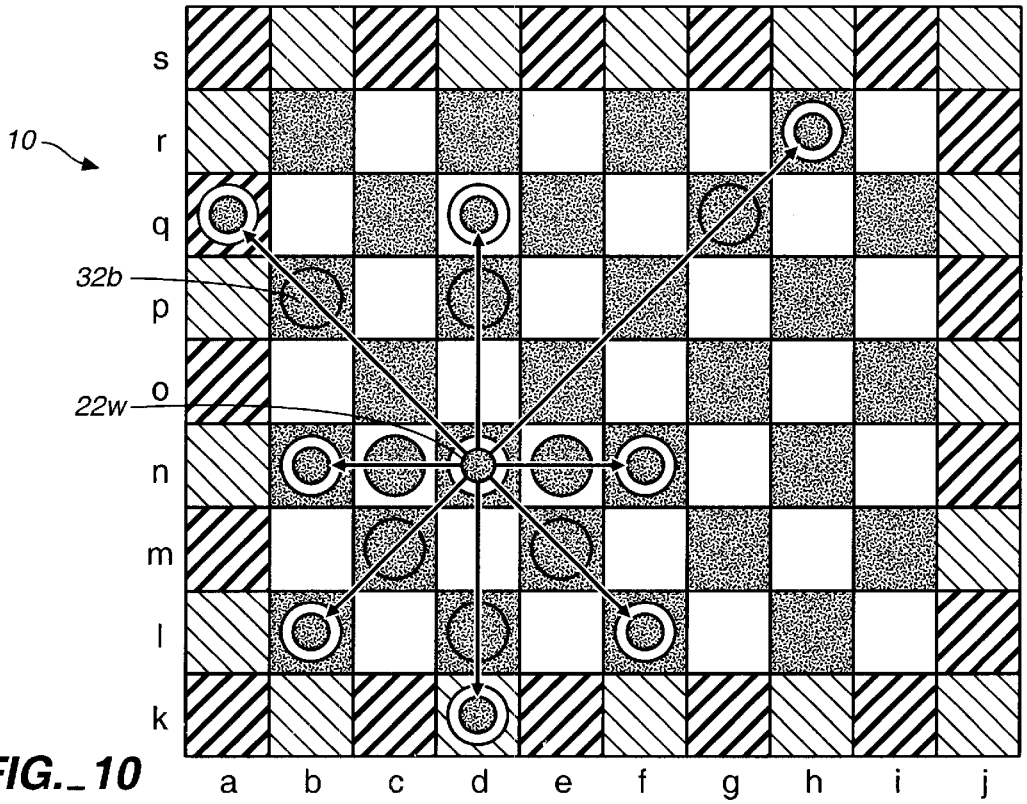
FIG. 10 is a plan view of the apparatus of FIG. 1, illustrating examples of the capture moves of the ambassador piece of FIG. 3.

FIG. 10 schematically illustrates the permissible range of capture moves for the ambassadors 22. The piece showing ambassador's white-set indicia 22*w* at (d,n) may capture the black set 4 piece at (e,n) by moving horizontally forward and jumping it, landing at the open square at (f,n). The same piece at (d,n) may capture the black set 4 piece at (b,p) by moving backwards diagonally and jumping it, landing at the open square at (a,q) in the sacrifice zone 44. Various other sample ambassador capture moves also are illustrated in FIG. 10.

Figure 11:
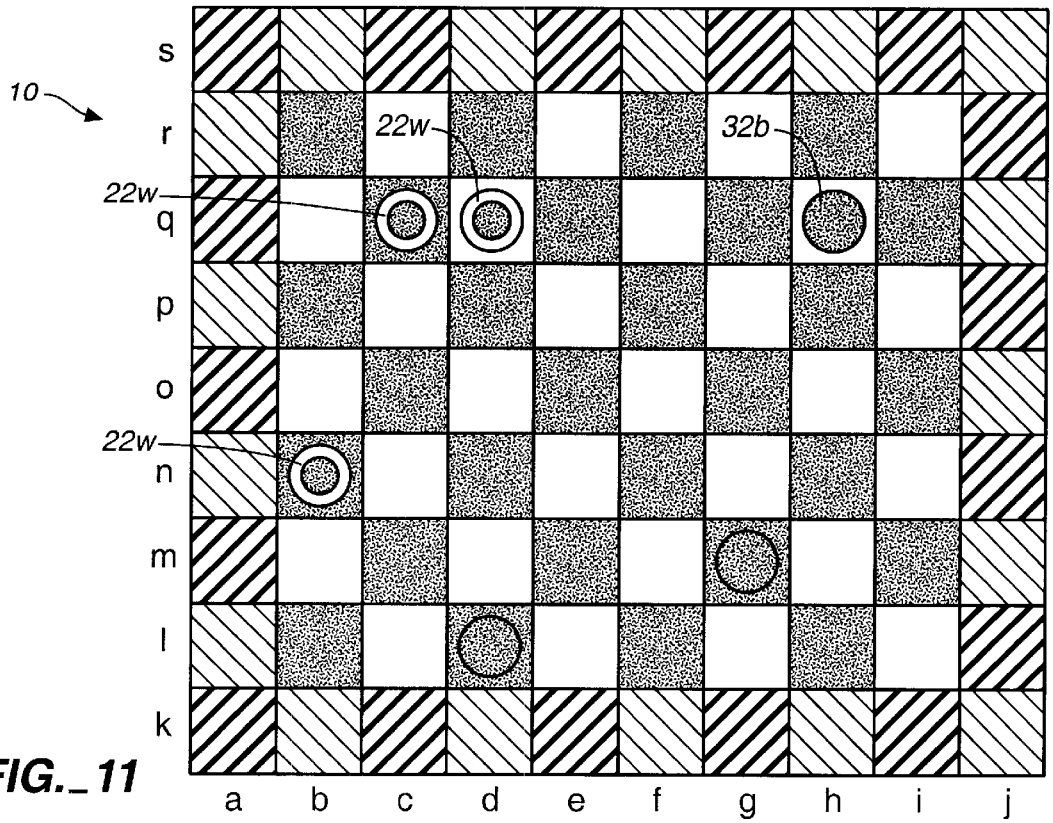
FIG. 11 is a plan view of the apparatus of FIG. 1, illustrating representative positions prior to capture moves of the ambassador piece of FIG. 3.
Figure 12:
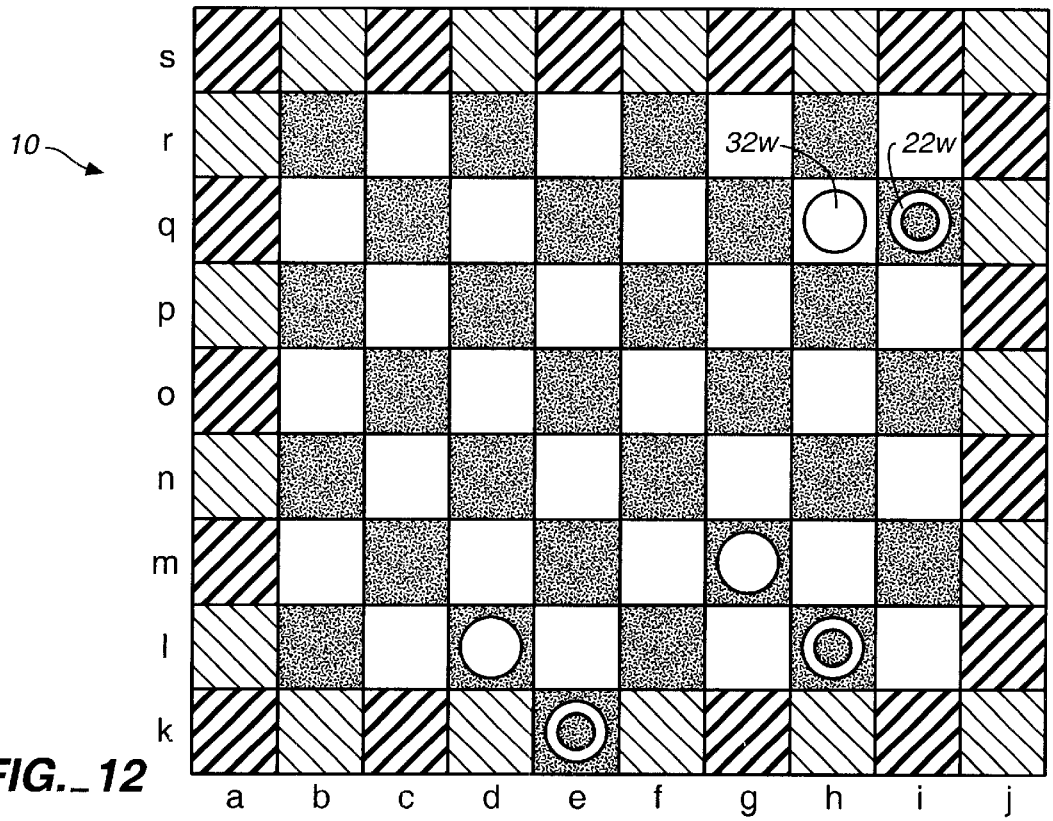
FIG. 12 is a plan view of the apparatus of FIG. 1, illustrating representative positions after capture moves of the ambassador piece of FIG. 3.

FIGS. 11 and 12 show sample before and after capture positions of ambassador's 22 bearing ambassador's white-set indicia 22*w*. FIG. 12 also shows the conversion of the captured pieces to the white set 2.

Figure 13:
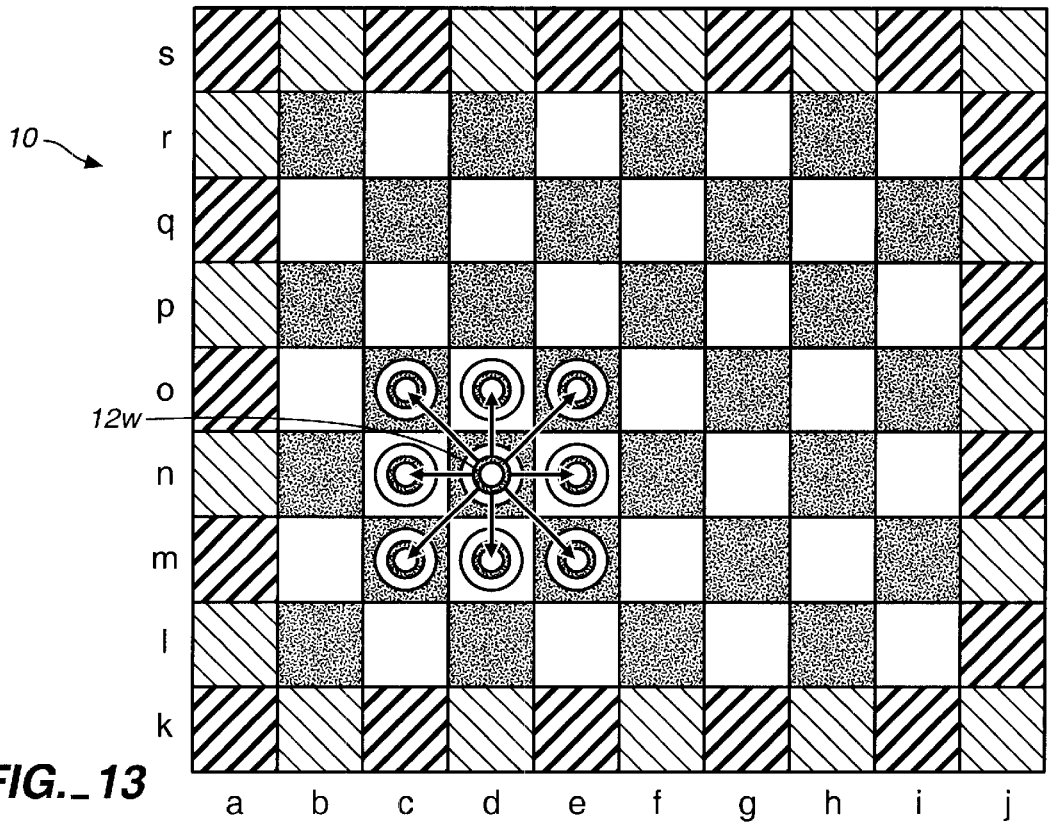
FIG. 13 is a plan view of the apparatus of FIG. 1, illustrating examples of the non-capture moves of the emperor piece of FIG. 2.

FIG. 13 schematically illustrates the permissible range of non-capture moves for the emperors 12. Emperors can move in any direction one square at a time on adjacent squares. They may not move onto a square that is attacked by an adverse piece or into the sacrifice zone 44. When an emperor is under attack, it must escape, for example, by seeking protection behind a piece or by capturing the attacker. The emperor is never actually captured—it is forced to capitulate, which is the object of the game. This situation happens when an emperor is under attack by one or more adverse pieces and it has no way to be protected or to escape without putting itself under another attack by an adverse piece. To symbolize the capitulation, the losing player must overturn his or her emperor or otherwise indicate that the game is over. Games can be drawn by mutual consent between players.

In FIG. 13, a single white set 2 emperor 12 piece (displaying ambassador's white-set indicia 22*w*) is on the board 40 at square (d,n). This piece may move to any adjacent square, namely, the squares in the range (c–e,m–o).

Figure 14:
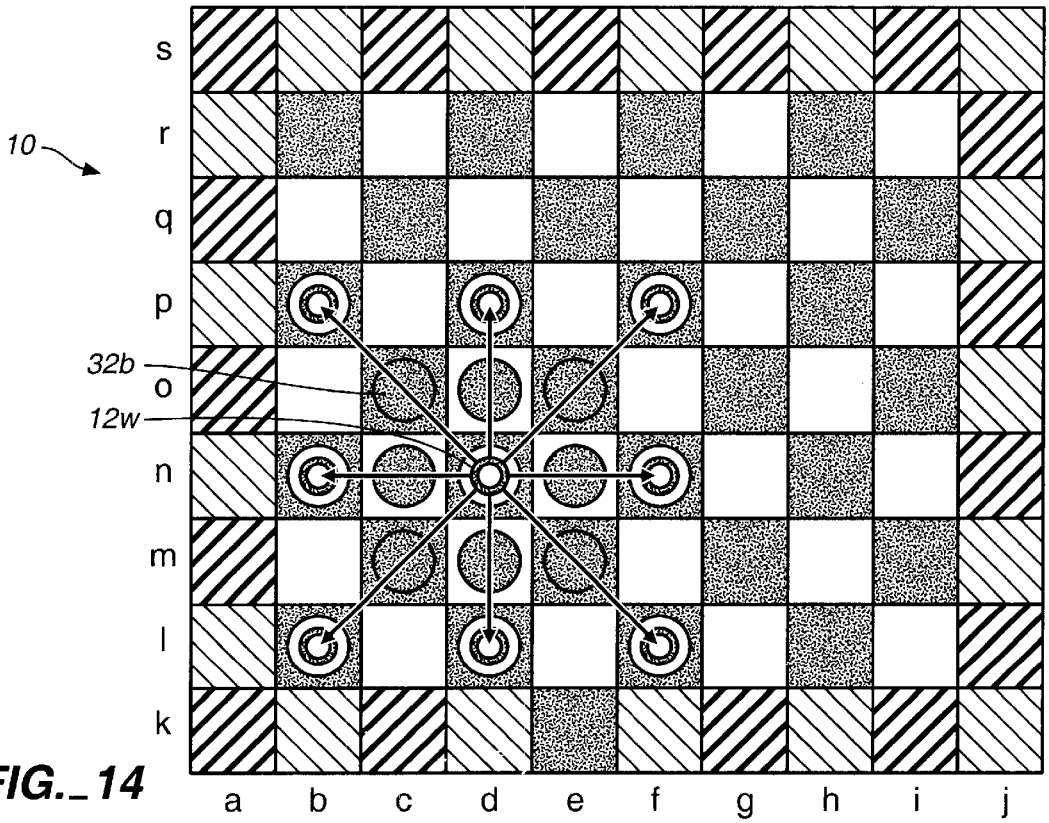
FIG. 14 is a plan view of the apparatus of FIG. 1, illustrating examples of the capture moves of the emperor piece of FIG. 2.

FIG. 14 schematically illustrates the permissible range of capture moves for the emperors 12. The piece showing emperor's white-set indicia 12*w* at (d,n) may capture the attacking black set 4 governor piece at (e,n) by moving horizontally and jumping it, landing at the open square at (f,n). The same piece at (d,n) may capture the black set 4 piece at (c,o) by moving backwards diagonally and jumping it, landing at the open square at (b,p). Various other sample emperor capture moves also are illustrated in FIG. 14.

Figure 15:
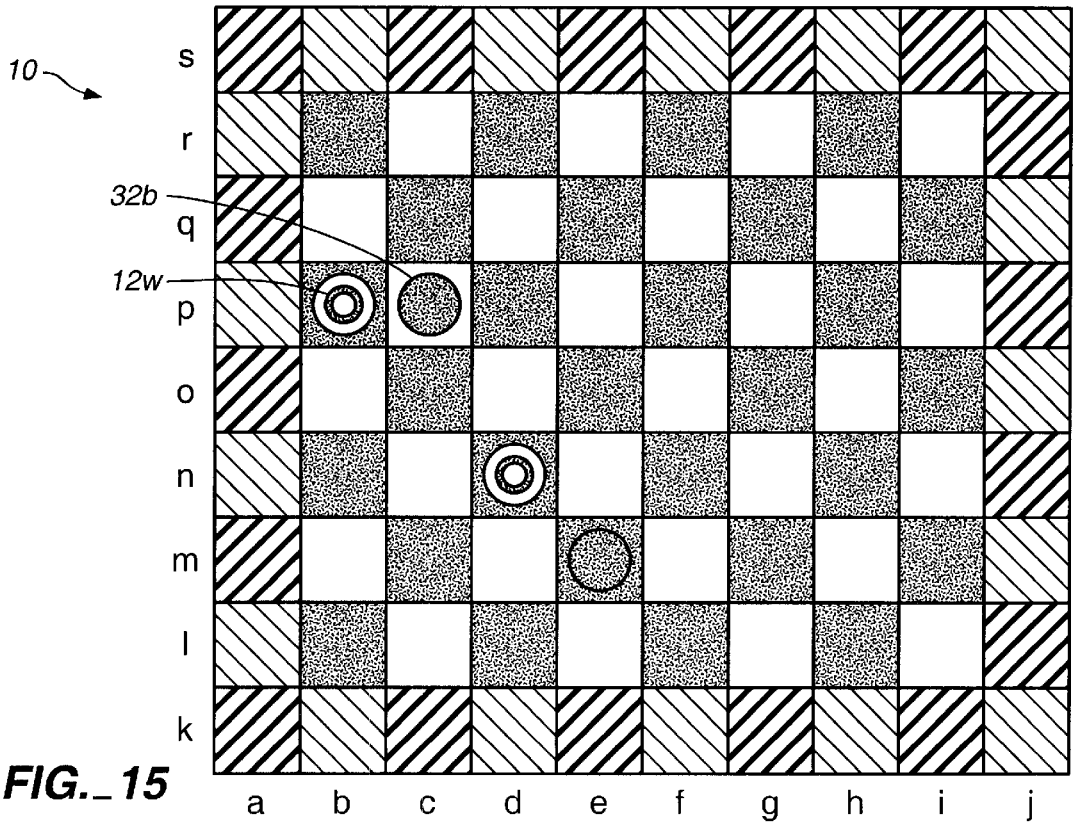
FIG. 15 is a plan view of the apparatus of FIG. 1, illustrating representative positions prior to capture moves of the emperor piece of FIG. 2.
Figure 16:
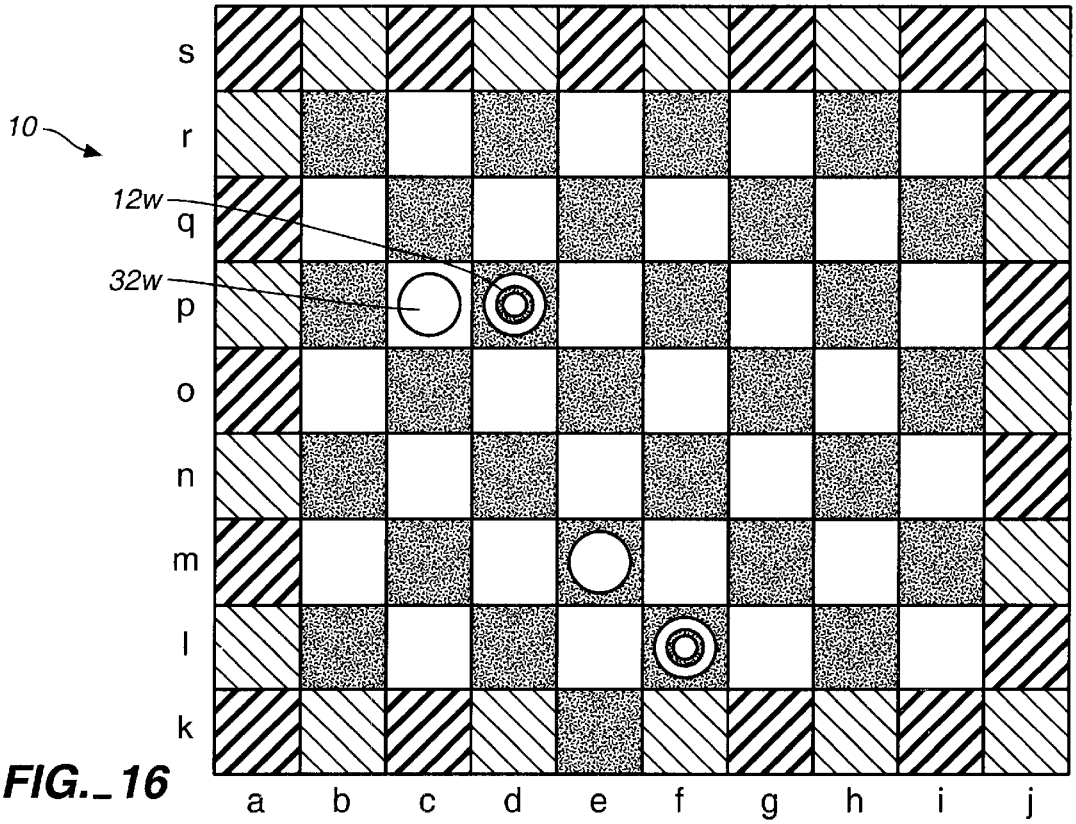
FIG. 16 is a plan view of the apparatus of FIG. 1, illustrating representative positions after capture moves of the emperor piece of FIG. 2.

FIGS. 15 and 16 show sample before and after capture positions of emperors 12 bearing emperor's white-set indicia 12*w*. FIG. 16 also shows the conversion of the captured pieces to the white set 2. Note, however, that in actual play there never would be more than one emperor of each color on the board. The emperor cannot end a capture move by entering the sacrifice zone 44.

As to the manner of usage and operation of the instant invention, the same should be apparent from the above disclosure, and accordingly no further discussion relative to the manner of play of the instant board game need be provided.

It will be perceived, however, that this game readily is adaptable for play in digital form on personal computers, electronic game devices and over the Internet, and such versions of the game comprise alternate embodiments of the present invention. Accordingly, the above discussion of the operation of the invention applies both to game boards and pieces having physical form and to digital depictions thereof on visual displays.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

For example, the three types of pieces (emperor, ambassador and governor) and the two types of "side" may be differentiated by indicia other than size and color. One alternate form of indicia would be raised or embossed markings.

Also, the cells of the board could be formed into shapes other than squares, for example: circles. By convention, such alternate shapes on game boards still are called "squares"—referring to a resting place for playing pieces rather than to any particular shape thereof.

While the three types of pieces are called herein emperor, ambassador and governor, such pieces could have other names, such as king, rook, pawn or the like. Accordingly, the words emperor, ambassador and governor, as used herein, refer to any three types of pieces that are visually distinguishable from each other and that are reversibly formable into two visually distinguishable playing sets. Similarly, the words black and white refer to any colors mutually distinguishable by darkness and lightness, respectively.

Different numbers of pieces and different numbers of board squares also may be substituted for the preferred number described above.

Therefore, the above description and illustrations should not be construed as limiting the scope of the invention, which is defined by the appended claims.

The invention claimed is:

1. A board game apparatus, including:

a playing board;

said playing board forming a territories playing field of squares formed into a grid of rows and columns;

said playing board forming a sacrifice zone playing field of squares surrounding said territories playing field;

a plurality of playing pieces divisible into a first and a second set of equal number; said first and second sets each comprising at least one emperor piece, a plurality of ambassador pieces, and a plurality of governor pieces;

said emperor pieces each having two emperor sides, one emperor side bearing distinguishing emperor's first-set indicia and the other emperor side bearing distinguishing emperor's second-set indicia;

said ambassador pieces each having two ambassador sides, one ambassador side bearing distinguishing ambassador's first-set indicia and the other ambassador side bearing distinguishing ambassador's second-set indicia; and said governor pieces each having two governor sides, one governor side bearing distinguishing governor's first-set indicia and the other governor side bearing distinguishing governor's second-set indicia, wherein said playing pieces may be arranged into said first and second sets by turning one half of said playing pieces first-set indicia side up and by turning the other half of said playing pieces second-set indicia side up, said playing board has ninety squares, said territories playing field has fifty-six squares, said sacrifice zone playing field has thirty-four squares, wherein said sacrifice zone playing field is visually distinguishable from said territories playing field, said territories playing field comprises squares of alternating first light and first dark colors, and said sacrifice zone playing field comprises squares of alternating second light and second dark colors.

2. A board game apparatus, including:

a playing board;

said playing board forming a territories playing field of squares formed into a grid of rows and columns;

said playing board forming a sacrifice zone playing field of squares surrounding said territories playing field;

a plurality of playing pieces divisible into a first and a second set of equal number;

said first and second sets each comprising two emperor pieces, twelve ambassador pieces, and fourteen governor pieces;

said emperor pieces each having two emperor sides, one emperor side bearing distinguishing emperor's first-set indicia and the other emperor side bearing distinguishing emperor's second-set indicia;

said ambassador pieces each having two ambassador sides, one ambassador side bearing distinguishing ambassador's first-set indicia and the other ambassador side bearing distinguishing ambassador's second-set indicia; and said governor pieces each having two governor sides, one governor side bearing distinguishing governor's first-set indicia and the other governor side bearing distinguishing governor's second-set indicia, wherein said playing pieces may be arranged into said first and second sets by turning one half of said playing pieces first-set indicia side up and by turning the other half of said playing pieces second-set indicia side up, said playing board has ninety squares, said territories playing field has fifty-six squares, said sacrifice zone playing field has thirty-four squares, wherein said sacrifice zone playing field is visually distinguishable from said territories playing field, said playing pieces may be arranged into said first set having fourteen playing pieces and said second set having fourteen pieces by turning one of said emperor pieces emperor's first-set indicia side up and by turning the other one of said emperor pieces emperor's second-set indicia side up, by turning six of said ambassador pieces ambassador's first-set indicia side up and by turning the other six of said ambassador pieces ambassador's second-set indicia side up, and by turning seven of said governor pieces governor's first-set indicia side up and by turning the other seven of said governor pieces governor's second-set indicia side up.

said emperor's first-set indicia comprises a solid white circle inside a black ring that is inside a white ring and said emperor's second-set indicia comprises a solid black circle inside a white ring that is inside a black ring, said ambassador's first-set indicia comprises a solid black circle inside a white ring and said ambassador's second-set indicia comprises a solid white circle inside a black ring, and said governor's first-set indicia comprises a solid white circle and said governor's second-set indicia comprises a solid black circle.

3. The apparatus of claim 2 wherein:

said emperor pieces are larger than said ambassador pieces and said ambassador pieces are larger than said governor pieces.

4. A board game apparatus, including:

a playing board;

said playing board forming a territories playing field of fifty-six squares formed into a grid of rows and columns;

said playing board forming a sacrifice zone playing field of thirty-four squares forming a perimeter that is one square wide that surrounds said territories playing field;

a plurality of playing pieces divisible into a first and a second set of equal number;

said first and second sets each comprising one emperor piece, six ambassador pieces, and seven governor pieces;

said emperor pieces each having two emperor sides, one emperor side bearing distinguishing emperor's first-set indicia and the other emperor side bearing distinguishing emperor's second-set indicia;

said ambassador pieces each having two ambassador sides, one ambassador side bearing distinguishing ambassador's first-set indicia and the other ambassador side bearing distinguishing ambassador's second-set indicia; and said governor pieces each having two governor sides, one governor side bearing distinguishing governor's first-set indicia and the other governor side bearing distinguishing governor's second-set indicia, wherein said playing pieces may be arranged into said first set having fourteen playing pieces and said second set having fourteen pieces by turning one of said emperor pieces emperor's first-set indicia side up and by turning the other one of said emperor pieces emperor's second-set indicia side up, by turning six of said ambassador pieces ambassador's first-set indicia side up and by turning the other six of said ambassador pieces ambassador's second-set indicia side up, and by turning seven of said governor pieces governor's first-set indicia side up and by turning the other seven of said governor pieces governor's second-set indicia side up, said territories playing field comprises squares of alternating first light and first dark colors, and said sacrifice zone playing field comprises squares of alternating second light and second dark colors.

5. The apparatus of claim 4 wherein:

said emperor's first-set indicia comprises a solid white circle inside a black ring that is inside a white ring and said emperor's second-set indicia comprises a solid black circle inside a white ring that is inside a black ring, said ambassador's first-set indicia comprises a solid black circle inside a white ring and said ambassador's second-set indicia comprises a solid white circle inside a black ring, and said governor's first-set indicia comprises a solid white circle and said governor's second-set indicia comprises a solid black circle.

6. The apparatus of claim 5 wherein:

said emperor pieces are larger than said ambassador pieces and said ambassador pieces are larger than said governor pieces.

* * * * *